US007284522B2

(12) United States Patent
Kamimura et al.

(10) Patent No.: US 7,284,522 B2
(45) Date of Patent: Oct. 23, 2007

(54) AUTOMATIC CHOKE

(75) Inventors: Kenji Kamimura, Saitama (JP); Kouichi Asai, Saitama (JP); Hitoshi Abe, Saitama (JP); Ryo Saito, Saitama (JP); Masashi Nakamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 167 days.

(21) Appl. No.: 11/075,668

(22) Filed: Mar. 10, 2005

(65) Prior Publication Data

US 2005/0199217 A1 Sep. 15, 2005

(30) Foreign Application Priority Data

Mar. 12, 2004 (JP) ..... 2004-070562
Mar. 18, 2004 (JP) ..... 2004-078207
Mar. 18, 2004 (JP) ..... 2004-078208

(51) Int. Cl.
*F02D 41/06* (2006.01)

(52) U.S. Cl. ..... 123/179.18; 123/399; 123/403

(58) Field of Classification Search ..... 261/39.1, 261/64.6; 123/337, 179.16, 179.18, 399, 123/403; 251/305, 128.11
See application file for complete search history.

(56) References Cited

U.S. PATENT DOCUMENTS 3,948,240 A * 4/1976 Hirosawa et al. ..... 123/179.16
4,200,064 A * 4/1980 Engele ..... 123/674
4,321,902 A 3/1982 Stoltman
4,391,249 A 7/1983 Bianchi et al.
4,463,723 A * 8/1984 Tansuwan ..... 123/438
4,500,478 A 2/1985 Furukawa et al.
4,524,742 A * 6/1985 Bonfiglioli et al. ..... 123/438
4,623,322 A * 11/1986 Melchior ..... 464/160
5,031,593 A * 7/1991 Erhard et al. ..... 123/331

FOREIGN PATENT DOCUMENTS

EP 1 323 911 A2 7/2003
JP 02238162 A * 9/1990
JP 5-280425 10/1993

* cited by examiner

*Primary Examiner*—Stephen K. Cronin
*Assistant Examiner*—Arnold Castro
(74) *Attorney, Agent, or Firm*—Westerman, Hattori, Daniels & Adrian, LLP.

(57) ABSTRACT

A choke valve is controlled finely suited to the running state of an engine. A throttle valve 8 and a choke valve 9 are provided in series on an intake pipe 6, and the opening degree of the choke valve 9 is controlled by a stepping motor 11. A choke valve opening degree upon start of engine (start opening degree) and a driving pulse rate of a stepping motor 11 are determined depending on the engine temperature. When lower than the engine temperature TL, the pulse rate is set at first rate, or the lowest rate in a specified range. Depending on the engine temperature, the pulse rate is set higher gradually up to second rate TH. When releasing the choke gradually in warm-up operation, the pulse rate is lowered so as to obtain a choke opening degree of high precision by a high torque.

12 Claims, 6 Drawing Sheets

Fig. 8

| | ENGINE TEMPERATURE (° C) | | | | | | | | | | | | | |
|---|---|---|---|---|---|---|---|---|---|---|---|---|---|---|
| | -25 | -20 | -15 | -10 | 0 | 10 | 20 | 30 | 40 | 50 | 60 | 70 | 80 | 80< |
| WORKING TIME FROM START OPENING DEGREE TO HALF OPEN (sec) | 40 | 15 | 10 | 7 | 4 | 2 | 2 | 1 | 1 | 1 | — | — | — | — |
| WORKING TIME FROM HALF OPEN TO FULLY OPEN (sec) | 50 | 25 | 20 | 12 | 5 | 2 | 1 | 1 | 1 | 1 | 1 | 1 | 1 | 1 |
| TOTAL TIME UNTIL CHOKE VALVE FULLY OPENS AFTER ENGINE START (sec) | 90 | 40 | 30 | 19 | 9 | 4 | 3 | 2 | 2 | 2 | 1 | 1 | 1 | 1 |

AUTOMATIC CHOKE

BACKGROUND OF THE INVENTION

1. Field of the Invention

The present invention relates to an automatic choke, and more particularly to an automatic choke capable of controlling air-fuel ratio favorably corresponding to temperature in the process of engine temperature rise after starting.

2. Description of the Related Art

An automatic choke used when starting a cold engine is designed to control a solenoid actuator or diaphragm actuator for operating a choke valve according to the temperature detected by a temperature detecting element such as thermostat. When starting a cold engine, by controlling the air-fuel ratio in a direction of concentrating the mixed air by the automatic choke, the engine can be started stably.

For example, Japanese Patent Application Laid-Open No. 5-280425 relates to a case of detecting a cold engine by a sensor composed of thermistor for issuing a detection signal corresponding to the temperature of the cylinder head, and discloses an automatic choke in which the choke solenoid is automatically actuated only in cold state for actuating the choke when starting up the engine, while the throttle valve is fully closed.

As in the device disclosed in the patent document, it is general to control the choke valve by using solenoid actuator. However, since the solenoid is controlled either in on or off state, near the end of the choke period, that is, when the necessary choke period is nearly over, it tends to be over-choke (insufficient opening of choke valve).

By contrast, using a bimetal as an actuator, it has been attempted to control the choke valve continuously. However, since the bimetal is poor in response to temperature changes, the choke releasing timing is delayed both when starting a cold engine and when restarting a warm engine, thus it only consumes time while sufficient output is not obtained.

SUMMARY OF THE INVENTION

It is an object of the present invention to present an automatic choke capable of controlling the choke valve accurately and finely while following up the engine temperature.

It is a first aspect of the invention to present an automatic choke for controlling the opening degree of a choke valve provided in an intake passage of the engine, depending on the temperature information representing the engine temperature upon start of engine, in which the opening degree of the choke valve upon start of engine is determined on the basis of the temperature information representing the engine temperature upon start of engine, and a motor is further provided for controlling the opening degree of the choke valve.

It is a second aspect of the invention to present an automatic choke, in which the time until releasing the choke by varying the opening degree of the choke valve from the opening degree upon start of engine to full opening is determined on the basis of the temperature information.

It is a third aspect of the invention to present an automatic choke, in which the motor for controlling the opening degree of the choke valve is a stepping motor, and comprises means for setting the pulse rate of driving pulses to be supplied to the stepping motor, and a low region value in the pulse rate setting range is used in the predetermined torque insufficient factor environment of the stepping motor.

It is a fourth aspect of the invention to present an automatic choke, in which the motor for controlling the opening degree of the choke valve is a stepping motor, and comprises means for setting the pulse rate of driving pulses to be supplied to the stepping motor, the stepping motor is initialized at the fully opened side or fully closed side of the choke valve, and the pulse rate setting means sets the pulse rate of the stepping motor larger when initializing the stepping motor by turning on the power for starting up the engine than in warming-up operation after initialization.

According to the first aspect of the invention, the choke valve opening degree upon start of engine is determined and controlled depending on the engine temperature or its ambient temperature. According to the second aspect of the invention, the duration from opening degree upon start of engine till full opening of choke valve, that is, the time from choke state to shock release is determined depending on the engine ambient temperature. Since the choke valve opening degree can be properly determined depending on the engine running condition represented by the engine temperature, the air-fuel ratio is controlled to an optimum value. Since the choke state is gradually released by controlling the choke valve by the motor, it is possible to avoid over-choke and drop of the air-fuel ratio nearly at the moment of fully opening the choke valve.

According to the third aspect of the invention, if the stepping motor is in a torque insufficient factor environment, the pulse rate is set low, that is, the number of output pulses per unit time is decreased, and the motor speed is reduced, and thereby the torque for driving the choke valve is increased, and out-of-tune can be avoided. By taking engine low temperature state into consideration as torque insufficient factor environment, for example, enough torque can be assured in case of increase of friction of shaft disturbing operation of choke valve at low temperature, and out-of-tune can be prevented.

According to the fourth aspect of the invention, the stepping motor driven in open loop can be initialized quickly at high pulse rate, and the pulse rate is lowered during warm-up operation and a large torque is obtained, so that the opening degree can be adjusted stably.

BRIEF DESCRIPTION OF THE DRAWINGS

FIG. 8 is a diagram showing an example of a choke release time corresponding to the engine temperature.

DETAILED DESCRIPTION OF THE PREFERRED EMBODIMENTS

Figure 1:
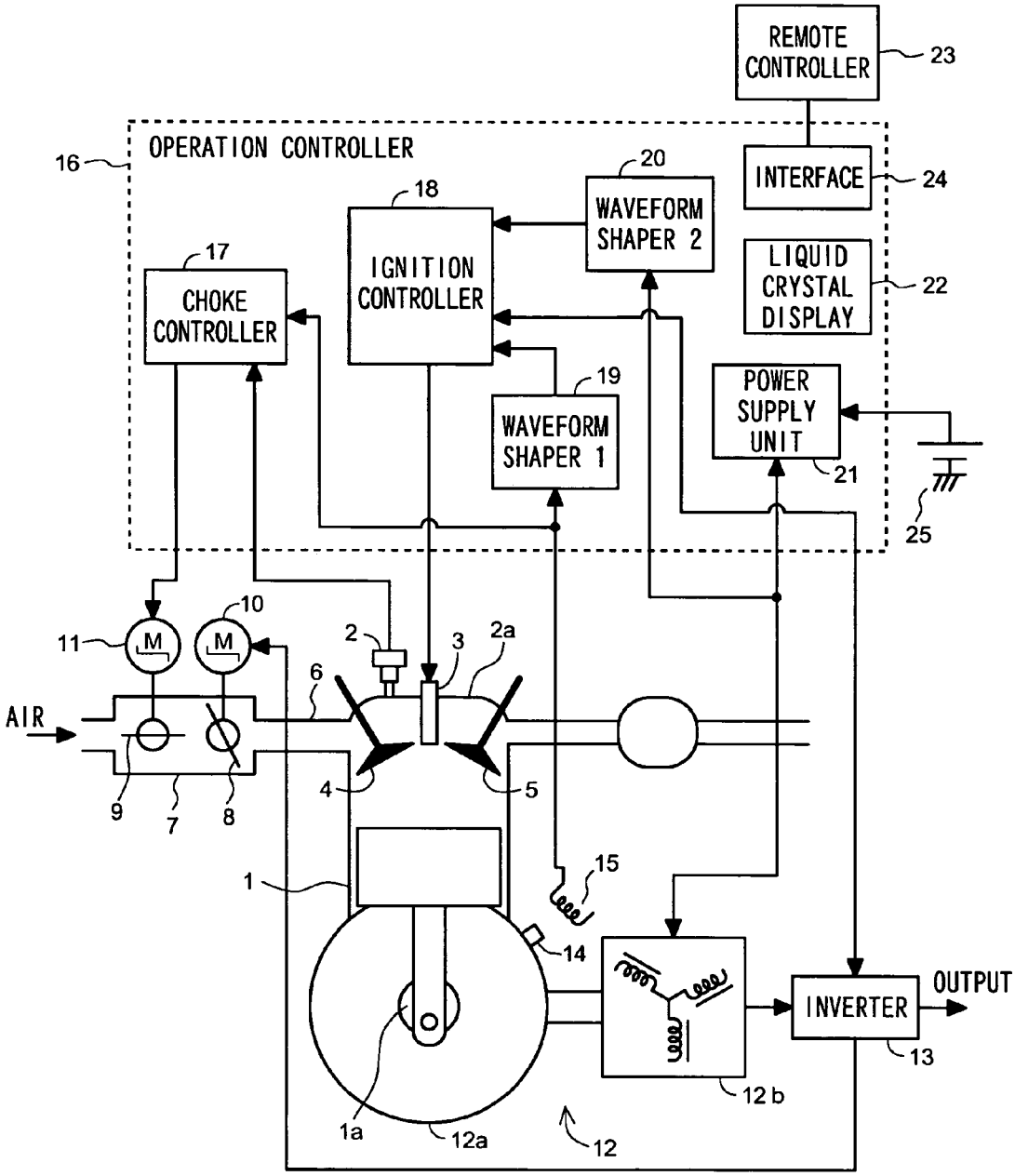
FIG. 1 is a block diagram of a system configuration of an automatic choke in an embodiment of the present invention.

Referring now to the drawings, the invention is specifically described below. FIG. 1 is a block diagram of system configuration of an automatic choke in an embodiment of the present invention. In the diagram, an engine is used as a driving source of a generator. The engine 1 includes a temperature sensor 2 for detecting the engine temperature. The temperature sensor 2 is provided, for example, on a cylinder head 2*a*. The cylinder head 2*a* includes an ignition plug 3, an intake valve 4, and an exhaust valve 5.

A carburetor 7 is connected to an intake tube 6 having the intake valve 4. The carburetor 7 includes a throttle valve 8 disposed at the downstream side, and a choke valve 9 disposed at its upstream. The throttle valve 8 is driven by a stepping motor 10 and opened or closed, and the choke valve 9 is driven by a stepping motor 11 and opened or closed.

The engine 1 is coupled to a generator 12. The generator 12 is driven by the engine 1, and generates alternating current. This alternating current is rectified, and converted into a specified frequency (commercial frequency of 50 or 60 Hz) by an inverter 13, and a commercial supply voltage is produced.

The generator 12 serving also as starter motor of the engine 1 comprises an outer rotor 12*a* having a magnet mounted on the inner circumference of a flywheel coupled to a crankshaft 1*a* of the engine 1, and a stator 12*b* on which power generating coil is wound. The crankshaft 1*a* may be coupled to a recoil starter (not shown) for manual starting.

The outer rotor 12*a* of the generator 12 includes a reluctor 14 for detection of ignition timing, and a before top dead center sensor (BTDC sensor) 15 for detecting the reluctor 14 is provided around the outer rotor 12*a*.

The ignition timing of the ignition plug 3 and opening degree of the choke valve 9 are controlled by an operation controller 16. A choke controller 17 outputs a control signal for driving the stepping motor 11 depending on the engine temperature detected by the temperature sensor 2 and the engine speed detected by the output of the BTDC sensor 15. According to this control signal, the stepping motor 11 operates the choke valve 9 so as to obtain an appropriate the air-fuel ratio corresponding to the temperature. The control operation of the choke controller 17 is described later.

The stepping motor 10 is controlled by an electronic governor so as to maintain the engine speed at a specified reference speed. The reference speed is variable with the magnitude of the load (the electrical load connected to the output side of the inverter 13).

An ignition controller 18 controls the ignition timing appropriately on the basis of the alternating-current waveforms of the BTDC sensor 15 and generator 12. Waveform shapers 19, 20 shape the output waveform from the BTDC sensor 15 and alternating-current output waveform from the generator 12, respectively. The ignition timing is controlled by the timing of waveform supplied from the waveform shapers 19, 20, but this is not essential point of the invention and the detail is omitted.

A power supply unit 21 supplies necessary power to the operation controller 16, and includes a battery 25, and a regulator for regulating the rectified voltage of the generator 12 (input side voltage of the inverter 13) at specified voltage. The operation controller 16 may also include a liquid crystal display 22 for displaying the running state of the generator 12 and the like. For remote control of the generator 12, an interface 24 may be provided for connection of a remote controller 23. The choke controller 17 and ignition controller 18 may be composed of microcomputers.

Figure 2:
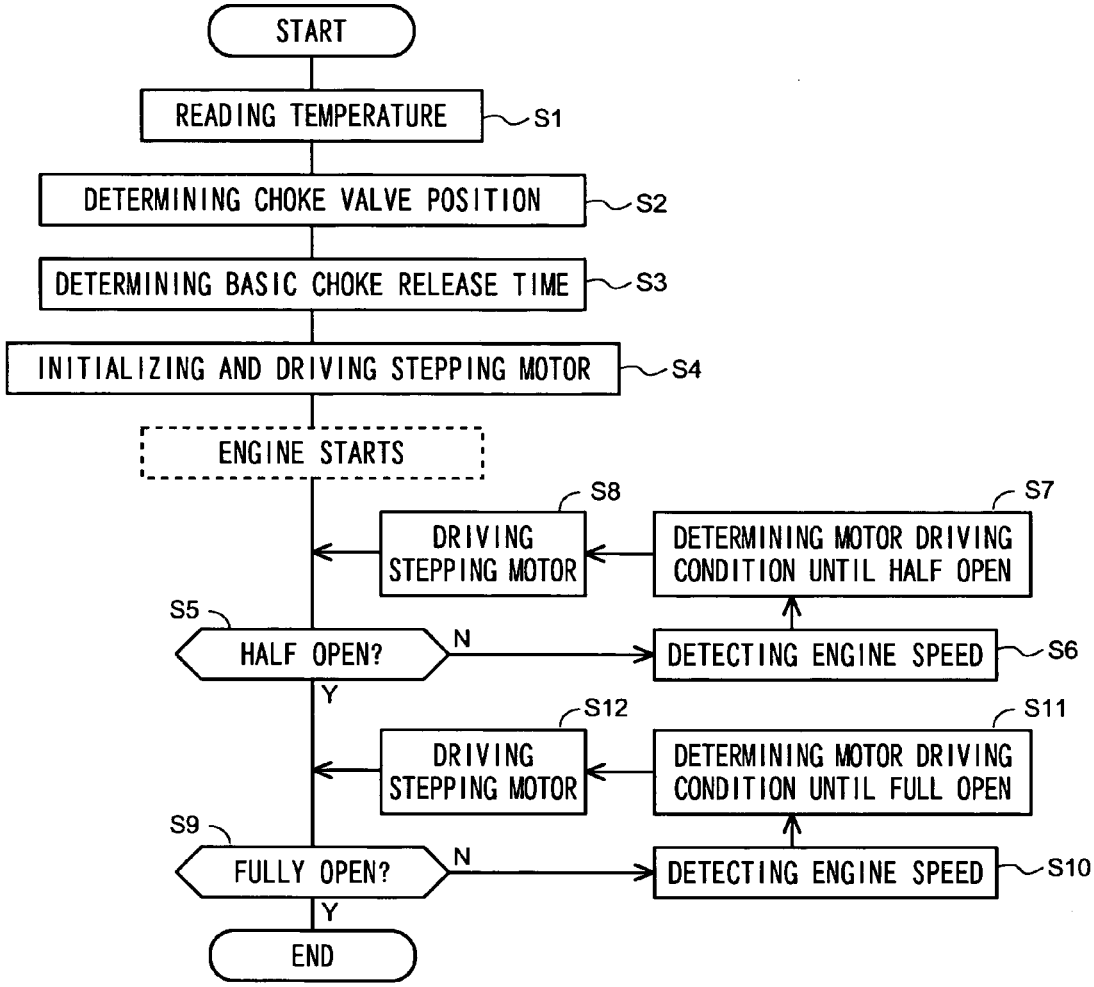
FIG. 2 is a flowchart of operation of a choke control unit.

FIG. 2 is a flowchart of operation of the choke controller 17. This process is started when the power supply unit 21 is energized by the electric power supplied from the battery 25. When the battery 25 has been overdischarged, the engine 1 is turned by the recoil starter, and the power supply unit 21 is energized by the power generation output from the generator 12 at this time.

Figure 7:
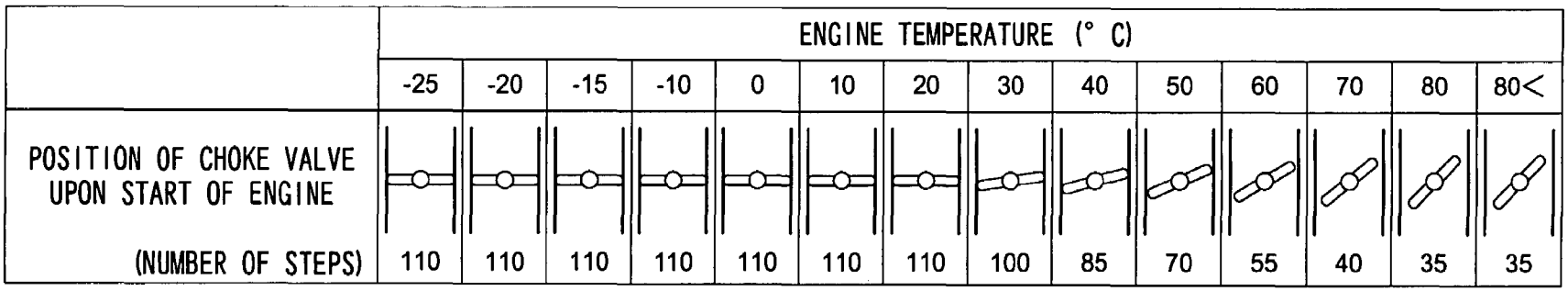
FIG. 7 is a diagram showing position of the choke valve at various engine temperature levels upon start of the engine.

First, at step S1, the detected temperature by the temperature sensor 2 is read in. At step S2, the position of the choke valve 9 (start opening degree or start opening angle) corresponding to the detected temperature is determined. The start opening degree is read out, for example, from a predetermined table as shown in FIG. 7. The position of the choke valve 9 is indicated by the number of steps to be supplied to the stepping motor 11. The detail of FIG. 7 is described later.

At step S3, for example using a predetermined table as shown in FIG. 8, the working time until release of choke corresponding to the engine temperature (basic choke release time) is determined. The detail of FIG. 8 is described later.

At step S4, first the stepping motor 11 is driven in order to initialize, and the stepping motor 11 is driven for rotating the choke valve 9 until start opening degree.

For initialization of the stepping motor 11, for example, as described specifically below, a driving signal of a predetermined number of steps is supplied to the stepping motor 11 so as to move the choke valve 9 to the fully closed side or fully opened side. In consequence, the choke valve 9 is fully closed or fully opened. The start opening degree of the choke valve 9 is determined on the basis of this fully closed or fully opened position.

When starting up the engine by driving the starter motor by battery, after initialization of the stepping motor 11, the choke valve 9 is moved to the start opening degree, and then the engine is started. On the other hand, when power cannot be supplied from battery, since the stepping motor 11 is driven and ignited by the power generation output obtained by manual revolution by the recoil starter, driving of the choke valve 9 and start of the engine are executed almost at the same time.

After the engine startup, at step S5, it is judged whether the choke valve 9 is opened to half or not. This is judged by the number of pulses supplied to the stepping motor 11 or by the number of steps of the driving signal. If the choke valve 9 is opened to less than half, advancing to step S6, the engine speed is detected. The engine speed can be detected on the basis of the output period of the BTDC sensor 15, but the method of detection is not particularly specified. At step S7, the motor driving condition until the choke valve 9 is opened to half is determined.

In determination of motor driving condition until half open, the basic choke release time determined at step S3 (working time from start opening degree to half open) is corrected. In this correction, as the engine speed is higher, the basic choke release time is shortened, and as the engine speed is lower, the basic choke release time is extended.

The number of driving pulses supplied to the stepping motor 11 in every driving period (for example, 0.7 sec) is determined on the basis of this driving period and the basic choke release time extended or shortened corresponding to increase or decrease of engine speed. When the number of pulses supplied per driving period is increased, it is fast to move to the choke release side, whereas if the number of pulses supplied per driving period is decreased, it is slow to move to the choke release side.

In this way, at step S7, the number of pulses or number of steps in every driving period to be supplied to the stepping motor 11 until the choke valve 9 is opened half from start opening degree is determined, and at step S8, the stepping motor 11 is driven in the determined motor driving condition (determined number of driving pulses or number of steps).

If it is judged at step S5 that the choke valve 9 is open to half, skipping to step S9, it is judged if the choke valve 9 is fully opened or not. Same as in judgement of half open, it is determined by the number of pulses or the number of steps supplied to the stepping motor 11.

If the choke valve 9 is not fully opened, going to step S10, the engine speed is detected. At step S11, the motor driving condition until the choke valve 9 is opened fully is determined. At step S11, too, same as at step S7, the basic choke release time by the engine speed (working time from half open to full open) is corrected, and the number of output driving pulses or number of steps in every driving period on the stepping motor 11 is calculated. At step S12, the stepping motor 11 is driven in the determined motor driving condition (determined number of pulses or number of steps) When the choke valve 9 is judged to be fully opened, this choke control is terminated.

Figure 3:
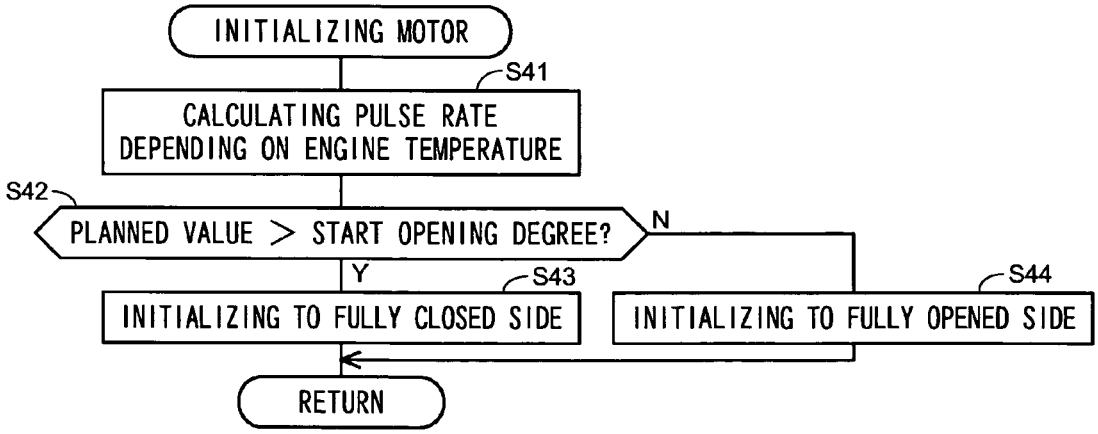
FIG. 3 is a flowchart of initializing process of a stepping motor.
Figure 4:
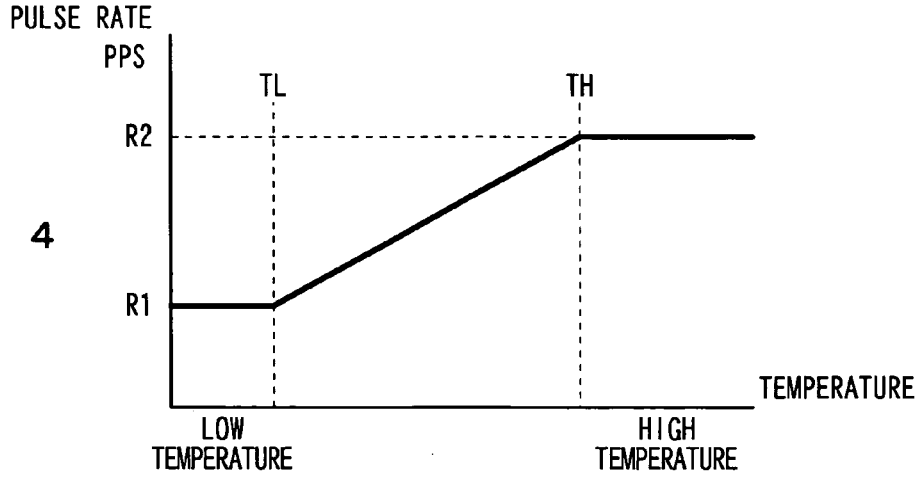
FIG. 4 is a table showing an example of pulse rate of the stepping motor corresponding to the engine temperature.

FIG. 3 is a specific flowchart of initialization (step s4) of the stepping motor 11. In the diagram, at step S41, the pulse rate of the stepping motor 11 is determined depending on the engine temperature. An example of setting table of pulse rate of the stepping motor 11 in relation to temperature is shown in FIG. 4.

At step S42, it is judged if the start opening degree determined at step S2 is less than the predicted value (for example, half open). If the start opening degree is less than half open, the process goes to step S43, and if the start opening degree is half open or more, the process goes to step S44.

At step S43, the stepping motor 11 is initialized at the fully closed side of the choke valve 9. That is, the choke valve 9 is turned to the fully closed side at the pulse rate determined at step S41. At step S44, the stepping motor 11 is initialized at the fully opened side of the choke valve 9. That is, the choke valve 9 is turned to the fully opened side at the pulse rate determined at step S41.

In this manner, when the start opening degree determined on the basis of engine temperature is at fully closed side, the choke valve 9 is driven to fully closed position, where the stepping motor 11 is initialized. On the other hand, when the start opening degree determined on the basis of the engine temperature is at fully opened side, the choke valve 9 is driven to fully opened position, where the stepping motor 11 is initialized. Thus, since initialization takes place at a side closer to the start opening degree, the choke valve 9 can be moved to the start opening degree in a shorter time after initialization.

In initialization of the stepping motor 11, the reason is as follows why the pulse rate is set as the function of engine temperature. Even if out-of-tune is caused by disturbance or drop of torque of stepping motor, it cannot be detected if the angle of rotation is deviated from the desired position, since the stepping motor is controlled in open loop.

In particular, at low temperature, frictional force of shaft of the choke valve 9 tends to increase. If this frictional force increases to about output torque of the stepping motor 11, out-of-tune is likely to take place. In the stepping motor, further, as the pulse rate increases, that is, as the pulse interval becomes smaller, it is known well that the output torque decreases.

Accordingly, as shown in FIG. 4, the pulse rate is determined by the function of engine temperature. In FIG. 4, the pulse rate of the stepping motor 11 is set somewhere between first rate R1 and second rate R2. The pulse rate is set at the lowest first rate R1 when the temperature is low, lower than first temperature TL, and set at the highest second rate R2 when the temperature is high, higher than second temperature TH. Between the first temperature TL and second temperature TH, as the engine temperature rises, it is set to increase the pulse rate gradually from first rate R1 to second rate R2.

Thus, when the engine temperature is low, the pulse rate is lowered to increase the output torque. As a result, out-of-tune can be suppressed.

The pulse rate of the stepping motor 11 is not always lowered only when the temperature is low. The stepping motor 11 may fall in torque shortage not only when the pulse rate is high, but also due to other factors. For example, if the supply voltage for driving the stepping motor 11 is insufficient, the output torque drops. The supply voltage drops when the voltage of the battery 25 is lowered, or power is not generated sufficiently, because the recoil starter is weak in torque. Therefore, by detecting this supply voltage, if the supply voltage is lower than the specified voltage, the pulse rate is lowered so as to obtain a sufficient torque.

When initializing the stepping motor 11, or when moving the choke valve 9 to the start opening degree, other torque insufficient factor environments than low engine temperature or low supply voltage can be preset. For example, increase of friction due to aging and deterioration is also one of the factors for impeding smooth operation of the choke valve 9.

Figure 5:
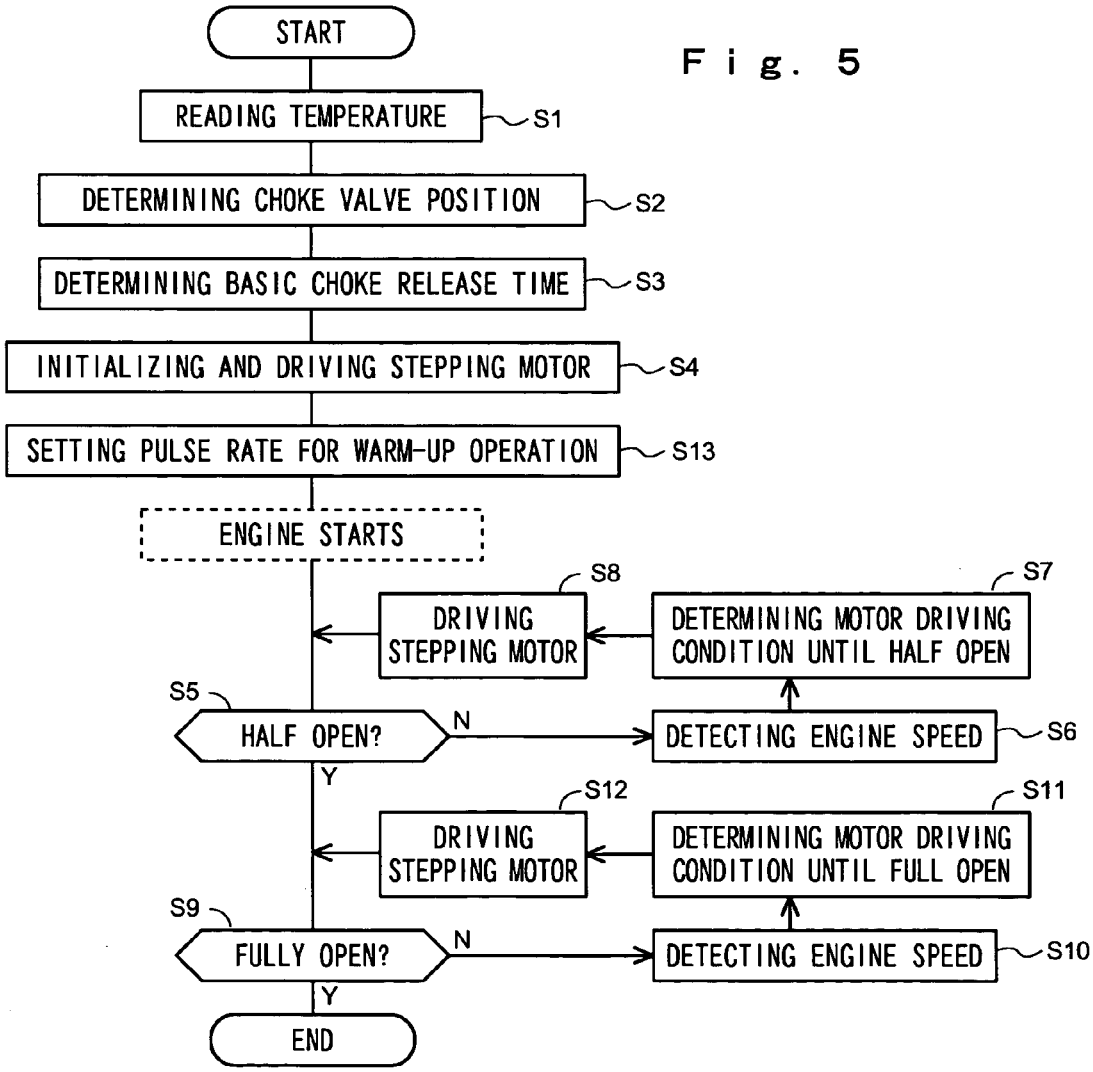
FIG. 5 is a flowchart of operation of the choke control unit in other embodiment of the invention.

Other embodiment of the invention is explained by referring to FIG. 5. It is a feature of this embodiment that step S13 is added in the flowchart in FIG. 2. That is, when the choke valve 9 is moved to the start opening degree, at step S13, the pulse rate of the stepping motor 11 in warm-up operation is determined. The pulse rate in warm-up operation is set to a fixed value lower than the pulse rate in initialization or move to start opening degree. During warm-up operation, since the choke valve 9 is opened slowly in the basic choke release time, fast driving of the stepping motor 11 is not demanded regardless of the engine temperature. Therefore, the pulse rate is set low so that the stepping motor 11 may be driven securely by a sufficient torque depending on the supply of driving pulses during warm-up operation.

On the other hand, the pulse rate of the stepping motor 11, that is, the number of output pulses per unit time when initializing at step S4 or when moving the choke valve 9 to the start opening degree is set larger than the pulse rate in choke release operation during warm-up operation. Since the stepping motor 11 is driven in open loop, the pulse rate is set larger when the choke valve 9 is desired to move quickly, that is, when initializing or when moving to the start opening degree.

In ordinary use, the stepping motor may be out-of-tune when the pulse rate is large in relation between output torque and pulse rate because rotor rotation cannot follow up the excitation. In such a case, in the stepping motor controlled in open loop, the rotor cannot rotate by a desired angle depending on the number of steps of given driving signal. That is, when releasing the choke, although a driving signal of the portion of number of steps corresponding to fully opened angle has been given to the stepping motor 11, the choke valve 9 may not be open fully due to out-of-tune.

Accordingly, after judging that the choke valve 9 is fully opened (after output of driving signal in the number of steps corresponding to fully opened angle), new control is started (which is called "fully opened feed control" below) for maintaining the fully opened state periodically.

Figure 6:
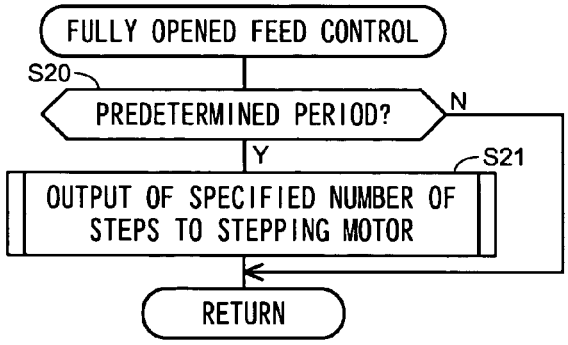
FIG. 6 is a flowchart of fully opened feed control periodically driving of the choke valve to the fully opened side.

FIG. 6 is a flowchart showing processing of essential parts of the choke controller for the fully opened feed control. At step S20, it is judged whether or not during the fully opened feed period for supplying driving signal to the stepping motor 11 in fully opened feed control. The fully opened feed period can be judged, for example, by providing the choke controller 17 with 2-second timer means, and checking if the timer means expires or not. If it is the predetermined fully opened feed period, going to step S21, a command (fully opened command) for fully opened feed is issued to the stepping motor 11. That is, a preset number of driving signals for moving the choke valve 9 to the fully opened side are sent out to the stepping motor 11. The number of driving signals for fully opened feed is, for example, 5 steps.

Fully opened feed may be executed at a specific timing after engine start, and it not limited to periodical timing.

FIG. 7 shows the position or start opening degree of the choke valve 9 at various engine temperatures upon start of engine, expressed by the number of steps of the stepping motor 11. In this example, the choke valve 9 is fully closed (number of steps=110) in an engine temperature range of minus 25° C. to 20° C., and the choke valve 9 is slightly open at engine temperature of 30° C. or higher. The choke valve 9 is half open (number of steps=55) at engine temperature of 60° C., and at higher temperatures the choke valve 9 is opened gradually up to the number of steps of 35.

As understood from this diagram, since at the engine temperature of 60° C. or less, the start opening degree is at closed side from the half open state, the stepping motor 11 is initialized at the fully closed side of the choke valve 9. Since, at the engine temperature of 60° C. or higher, the start opening degree is at opened side from the half open state, and the stepping motor 11 is initialized at the fully opened side of the choke valve 9.

FIG. 8 is an example showing choke release time corresponding to the engine temperature. This is an example of basic choke release time when the engine speed is controlled by an electronic governor to be at reference speed of 3300 rpm. Therefore, if the reference speed varies with fluctuations of the load connected to the generator 12, the basic choke release time (working time until half open, and working time from half open to full open) is corrected depending on the engine speed. That is, when the load increases and the engine speed changes somewhat higher than the reference speed, the choke release time is shortened, and when the load decreases and the engine speed changes somewhat lower than the reference speed, the choke release time is extended. Thus, the choke release time is corrected to be appropriate depending on the running condition of the generator 12, that is, the engine 1.

Figure 9:
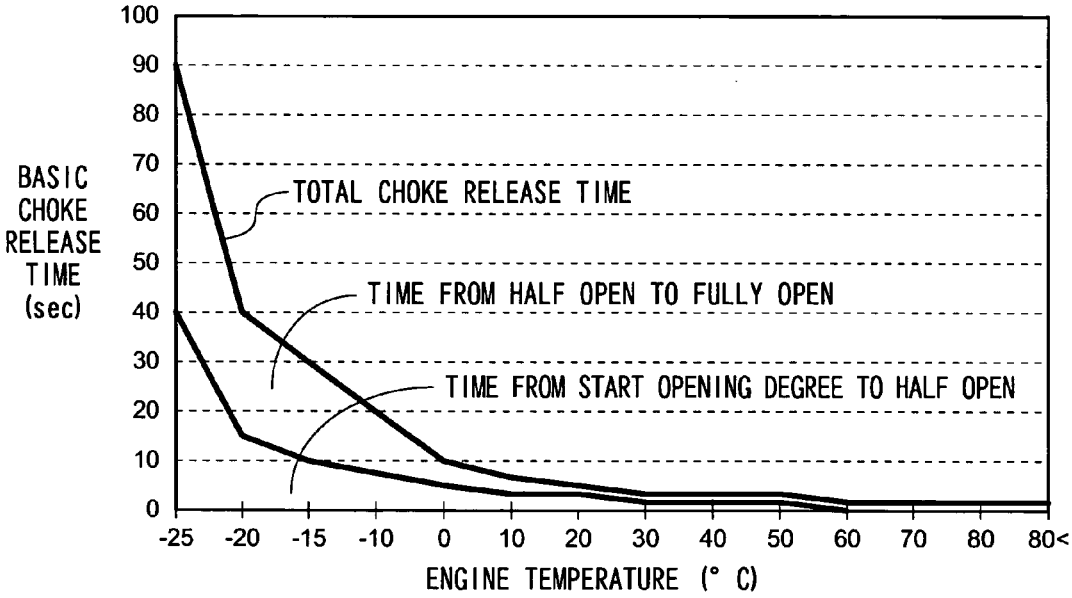
FIG. 9 is a graph showing an example of the choke release time corresponding to the engine temperature.

FIG. 9 shows the graph representing an example of FIG. 8. As this graph, the choke release time is determined due to the engine temperature upon start.

In this embodiment, the stepping motor is used as the driving source of the choke valve, but not limited to the stepping motor, for example, a servo motor may be similarly used.

The engine temperature is represented by the temperature of the cylinder head 2*a*, but the engine temperature for choke valve control is not limited to the temperature at this position. For example, a temperature sensor may be installed in an oil pan or water jacket for engine cooling water, and the temperature of lubricating oil or temperature of engine cooling water may be detected, and used as engine temperature. Besides, any temperature information detected in engine case parts capable of representing the engine temperature may be employed in the choke valve control of the invention.

What is claimed is:

1. An automatic choke for controlling an opening degree of a choke valve provided in an intake passage of an engine, depending on temperature information representing an engine temperature upon start of the engine, comprising:

means for determining the opening degree of the choke valve upon start of the engine on the basis of the temperature information representing the engine temperature upon start of the engine; and a motor for controlling the opening degree of the choke valve, wherein the engine is controlled so as to settle at a predetermined reference speed, and wherein the time until releasing the choke by varying the opening degree of the choke valve from the opening degree upon start of the engine to full opening depends on the reference speed, and is set shorter when the predetermined reference speed is higher, and longer when the predetermined reference speed is lower.

2. The automatic choke of claim 1, wherein the time until releasing the choke by varying the opening degree of the choke valve from the opening degree upon start of the engine to full opening is determined on the basis of the temperature information.

3. An automatic choke for controlling an opening degree of a choke valve provided in an intake passage of an engine, depending on temperature information representing an engine temperature upon start of the engine, comprising:

means for determining the opening degree of the choke valve upon start of the engine on the basis of the temperature information representing the engine temperature upon start of the engine; and a motor for controlling the opening degree of the choke valve;

wherein the time until releasing the choke by varying the opening degree of the choke valve from the opening degree upon start of the engine to full opening is determined on the basis of the temperature information;

wherein the choke is released toward an opening degree target in two stages, a first stage being from start opening degree to half open and a second stage being from half open to fully open, and the working time of the choke valve until reaching each opening degree target is determined individually.

4. An automatic choke for controlling an opening degree of a choke valve provided in an intake passage of an engine. depending on temperature information representing an engine temperature upon start of the engine, comprising:

means for determining the opening degree of the choke valve upon start of the engine on the basis of the temperature information representing the engine temperature upon start of the engine; and a motor for controlling the opening degree of the choke valve, wherein the motor for controlling the opening degree of the choke valve is a stepping motor, and said automatic choke comprises:

means for setting a pulse rate of driving pulses to be supplied to the stepping motor, and wherein a low region value in a pulse rate setting range is used in a predetermined torque insufficient factor environment of the stepping motor.

5. The automatic choke of claim 4, wherein the torque insufficient factor environment is a state wherein the temperature information is lower than a preset value.

6. The automatic choke of claim 4, wherein the torque insufficient factor environment is a state wherein a voltage of a driving source of the stepping motor is lower than a preset value.

7. The automatic choke of claim 4, wherein a driving power source of the motor is an electric power generated by a recoil starter provided in the engine.

8. The automatic choke of claim 4, wherein the time required for moving the choke valve from the opening degree upon start of the engine to opening degree for releasing choke is determined on the basis of the temperature information.

9. An automatic choke for controlling an opening degree of a choke valve provided in an intake passage of an engine, depending on temperature information representing an engine temperature upon start of the engine, comprising:

means for determining the opening degree of the choke valve upon start of the engine on the basis of the temperature information representing the engine temperature upon start of the engine; and a motor for controlling the opening degree of the choke valve, wherein the motor for controlling the opening degree of the choke valve is a stepping motor, and wherein said automatic choke comprises means for setting a pulse rate of driving pulses to be supplied to the stepping motor, wherein the stepping motor is initialized at a fully opened side or fully closed side of the choke valve, and wherein the means for setting the pulse rate sets the pulse rate of the stepping motor to be larger when initializing the stepping motor by turning on the power for starting up the engine than when in a warm-up operation after initialization.

10. The automatic choke of claim 9, wherein the pulse rate when initializing the stepping motor is determined on the basis of the temperature information.

11. The automatic choke of claim 9, wherein the start opening degree of the choke valve is determined on the basis of the temperature information, and a large pulse rate when initializing is maintained until the choke valve is moved to the start opening degree.

12. The automatic choke of claim 11, wherein a fully opened command for driving the choke valve to the fully opened side is issued at a specified timing after releasing of the choke state by the choke valve.

* * * * *